United States Patent [19]

Peterson

[11] 4,063,227

[45] Dec. 13, 1977

[54] SMOKE DETECTOR

[75] Inventor: Christian C. Peterson, Westwood, Mass.

[73] Assignee: Cega, Inc., Wilmington, Del.

[21] Appl. No.: 610,982

[22] Filed: Sept. 8, 1975

[51] Int. Cl.[2] ..... G08B 17/10

[52] U.S. Cl. ..... 340/237 S; 250/552; 250/574

[58] Field of Search ..... 340/237.5, 227 R, 228 S; 250/552, 573, 574, 221

[56] References Cited

U.S. PATENT DOCUMENTS

| | | | |
|---|---|---|---|
| 3,534,351 | 10/1970 | Harnden, Jr. et al. | 340/237 S |
| 3,887,836 | 6/1975 | Leete | 250/552 X |
| 3,917,956 | 11/1975 | Malinowski | 340/237 S X |

*Primary Examiner*—John W. Caldwell, Sr.
*Assistant Examiner*—Daniel Myer
*Attorney, Agent, or Firm*—Gerald L. Smith

[57] ABSTRACT

Smoke detector apparatus characterized in the utilization of solid state components in conjunction with standard primary batteries as a power source. Operating under photo-optical principles, the apparatus incorporates a solid state detector which, while having a low current drain characteristic, exhibits dark current phenomena. A stabilization network is provided to accommodate for this phenomena which includes an amplifier having a transistor stage and means for clamping that stage in a partially forwardly biased state. Detection of smoke causes the amplifier to generate a signal output as a step function.

18 Claims, 2 Drawing Figures

SMOKE DETECTOR

BACKGROUND

Smoke detection devices have been introduced or proposed to the market place in a wide variety of configurations ranging from the simple and crude to highly sophisticated and concomitantly expensive systems intended for industrial or military applications.

The consuming public is now becoming aware of the value of some form of fire warning system for the home. For acceptance into this popular market, such devices must be made available in large volume at reasonable prices, yet should retain a technical sophistication assuring as high a sensitivity as possible, and, of particular importance, an assured extended term reliability.

Improved sensing techniques now provide design opportunity to achieve a relatively high rate of response to smoke or related combustion products. For instance, those sensing techniques in general use may be photo-optical of a variety wherein the occlusion of a direct beam of select radiation is detected; or through utilization of the Tyndall effect, responding to particle reflectance. Additionally, ionization devices are available for combustion product detection.

While such detection schemes are known, a fire protection arrangement incorporating one of the above-cataloged sensors must also meet somewhat extensive consumer criteria. For example, the entire detection and alarm system should be packaged as a relatively small, convenient unit readily mountable while remaining unobtrusive at such locations within a household as the ceiling or upper wall of a selected room or stairwell. The distaff element of most households as well as an increasing number of governmental building codes show preference or require alarm units which are not line energized, i.e., which incorporate battery power supplies while still retaining compact overall configurations.

To the present, however, conventional, readily available batteries have been found to exhibit output characteristics unsuited to the demands of compact fire alarm units. Accordingly, specialized power supplies not readily available and expensive have been required for operating the detector-alarm units. Generally, the operating lifespan for these batteries is limited to a one-year duration.

Another performance aspect prevalent in certain existing smoke detection systems resides in the exhibition of a diminishing acuity or responsiveness over their operational lifespan. This undesirable attribute obtains in both line as well as battery powered systems. In certain instances, rather elaborate adjustment procedures are required of the operator following suggested intervals of operation to accommodate for sensitivity fall-off. Where battery power supplies are incorporated, sensing acuity generally diminishes in correspondence with the lessening of battery output. Of course, the reliability of all such systems is subject to question where any significant form of attendance to adjustment detail is required on the part of the lay public.

From the foregoing, it may be observed that what would be considered most desirable attributes for smoke detectors suited for the noted broadened consumer market would be a compact, battery powered unit which may remain unattended over relatively extended periods of time. Further, such a unit should be powered by small universally available and popularly priced batteries. Additionally, it is desirable that the alarm units be capable of generating a positive, perceptive signal indicating an active ongoing surveillance condition. From the standpoint of reliability, the sensitivity of the smoke detection units should not diminish with corresponding fall-off of available battery derived power.

In addition to the above criteria, the detector-alarm units must be structured to perform reliably under relatively extreme environmental conditions as required by national testing organizations. For instance, such conditions include a necessary circuit stability over broad ranges of temperature. While circuit techniques utilizing, for example, silicon components suggest that low power consumption detector systems might be designed, the sensitivity of such components to temperature excursions heretofore has blocked their implementation within practical smoke detector designs.

SUMMARY OF THE INVENTION

The present invention is addressed to a novel smoke detector circuit and device which provides highly sensitive and reliable surveillance of the aerosol state of the atmosphere within a given environment. This quality performance is achieved with a power supply provided by readily available, relatively inexpensive batteries, i.e., "C" cells or the like. Operable within a surveillance mode for over a year using such power supply, the circuit arrangement of the invention is uniquely efficient while maintaining highly reliable performance characteristics.

The invention particularly is characterized in the utilization of Tyndall effect type optical sensing of smoke while retaining the attribute of maintaining sensitivity during the diminution of battery derived input power levels.

Another aspect and object of the invention resides in the provision of a light emitting diode (LED) as a sensing light source in combination with a unique regulation of the voltage applid to the diode so as to assure continual stability of that component of the sensing function of the circuit. The circuit further may incorporate an intermittently energized perceptible light emitting diode which functions to apprise the user that the smoke detector unit is operating properly within its surveillance mode. This same LED further is utilized as an operational component of the above-discussed voltage regulation scheme, such arrangement contributing one of the circuit features deriving the important power efficiency attributes of the circuit.

The surveillance and sensing circuit of the invention further is characterized in remaining uniquely immune to sensitivity change over a relatively broad range of environmental temperatures. Through an arrangement wherein a silicon-type photo-detector is utilized in conjunction with a stabilization network, the advantages of a low power consuming system are coupled with an additionally advantageous high response rate. The stabilization arrangement responds to discriminate signal conditions representing dark current phenomena from aerosol detect signal conditions by recognizing the a.c. nature of the latter. For instance, inasmuch as the smoke or aerosol detect signals are generated only within the time frame of a substantially short surveillance interval, which interval occurs at a relatively lengthier sampling frequency, a discrimination wherein the detect signal is derived as a step function is achieved to provide positive alarm actuation.

Another feature and object of the invention is to provide a unique response arrangement within aerosol surveillance apparatus which combines gate signal reception with a gate threshold condition which, under conditions wherein battery power voltages fall below normal operational ranges, serve to heighten triggering sensitivity.

Other objects of the invention will in part be obvious and will in part appear hereinafter.

The invention, accordingly, comprises the system and apparatus possessing the construction, combination of elements and arrangement of parts which are exemplified in the following detailed disclosure.

For a fuller understanding of the nature and objects of the invention, reference should be had to the following detailed description taken in conjunction with the accompanying drawings.

DETAILED DESCRIPTION

Figures 1, 2:
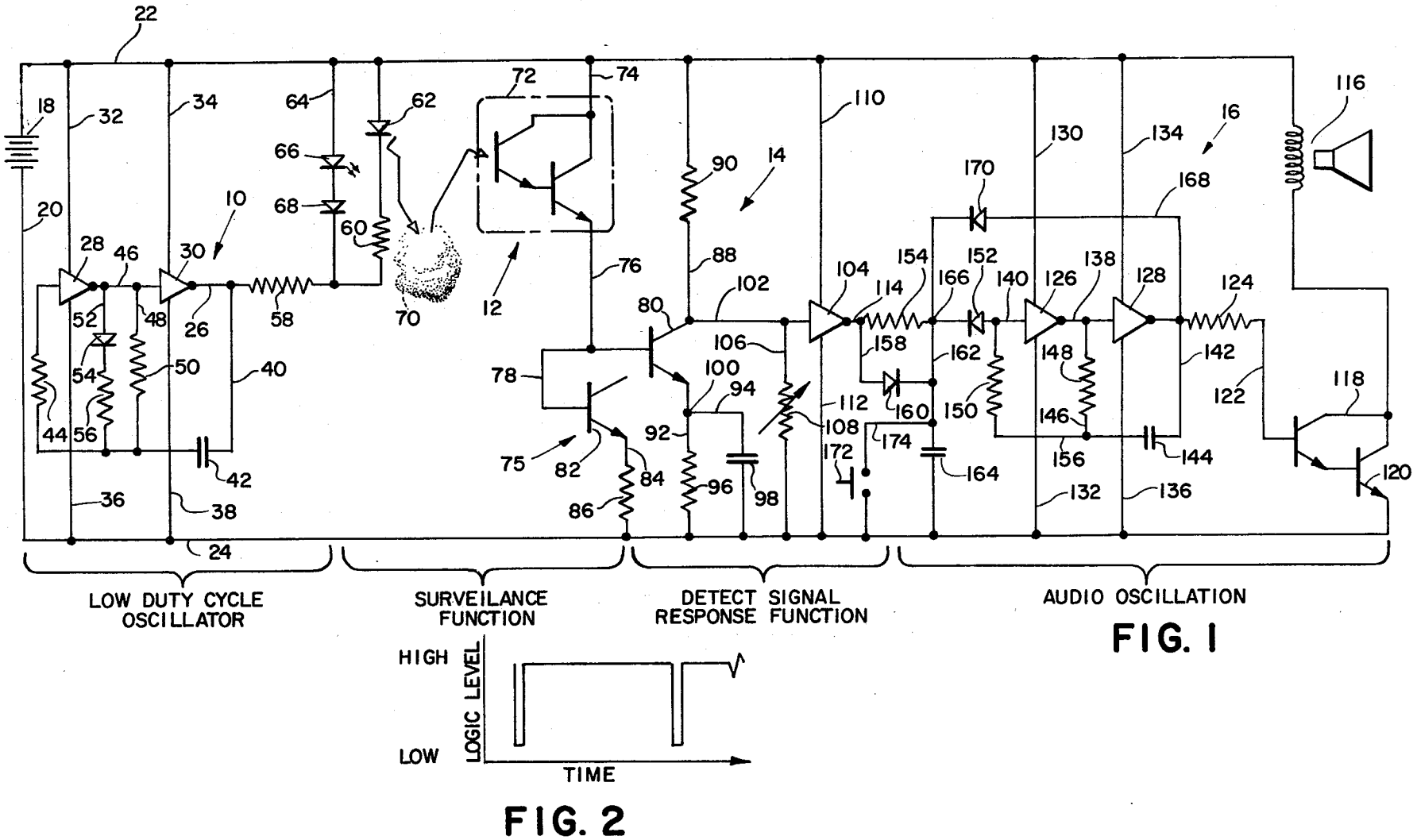
FIG. 1 is a schematic drawing of the logic circuit of the invention.
FIG. 2 is an exaggerated curve portrayal of the output of a low duty cycle function of the invention.

The smoke surveillance and alarm circuit of the invention is lent to incorporation within a wide variety of very compact housings. Such housings generally will include portions designated to retain a battery power supply, a light tight smoke or aerosol reception chamber and an acoustic transducer, for instance, a p.m. loudspeaker. As will become apparent as the instant description unfolds, a particularly advantageous aspect of the present circuit resides in its very low power or current requirements. For instance, the circuit is readily powered within its surveillance mode for periods or service intervals of over a year utilizing conventional and locally available standard "C" batteries. Inverter gates formed of COS/MOS circuits are utilized in developing the logic to be described, such circuits generally consisting of one p-channel and one n-channel enhancement-type MOS transistor which are combined to provide conventional inverter logic. Such gates exhibit very little power drain when the circuit is in a quiescent state, thereby contributing one facet to the noted high efficiency of the system. For purposes of facilitating the description to follow, when the inputs or outputs of these gate designated components are at a ground or appropriately pass a corresponding reference potential, they are referred to as "low". Conversely, when these inputs or outputs assume or approach the voltage status of the power supply, they are referred to as being "high". Additionally in the interest of clarity, basic functional portions of the schematic circuit drawing are labeled.

Looking to the drawing, the detection and alarm system is seen generally to comprise a low duty cycle oscillator network 10, a surveillance function 12 for sampling a designated light tight or dark environment for the presence of an aerosol, a network 14 functioning to respond to a detecting signal from network 12, and an audio oscillation network 16 for providing an audible alarm. Networks 14 and 16 will be seen to remain in a quiescent state during the surveillance mode of operation of the system, i.e., that mode wherein intermittent sampling is carried out and no aerosols are detected at surveillance function 12. It may be noted that the operational association of networks 14 and 16 with low duty cycle network 10 is only through function 12.

Power is supplied to the circuit from batteries as described above and shown at 18, for instance, four serially coupled standard "C" cells may be utilized for supplying power from line 20 to power lines 22 and 24. As power is applied to the circuit from these lines, low duty cycle oscillator network 10 is activated and commences to function as an astable multivibrator having an output at line 26 oscillating between high and low voltage values recurring in a manner wherein low conditions are retained for a relatively short interval, i.e., about 50 milliseconds and are separated by relatively lengthened high value intervals, for instance, of about one second duration. The resultant frequency of low output values represents the sampling frequency of the system and, as is apparent, is selected to optimize the efficiency of power utilization.

Network 10 incorporates two inverter gates 28 and 30 coupled for power input from line 22, respectively from lines 32 and 34 and to opposite power line 24, respectively, from lines 36 and 38. These COS/MOS gates provide conventional inverter logic, a high or low value applied at their inputs, respectively, deriving a low or high value at their outputs. The output at line 26 of gate 30 is connected through line 40, capacitor 42 and a stabilizing resistor 44 to the input of gate 28. A line 46 connects the output of gate 28 with the input of gate 30 and, in turn, is connected with one end of a line 48 incorporating a timing resistor 50. Additionally, line 46 is connected with one end of a line 52 incorporating a steering diode 54 and another timing resistor 56. The opposite ends of lines 48 and 52 are coupled with line 40 at locations intermediate resistor 44 and capacitor 42. Resistor 50 is selected having a significantly higher impedance value than resistor 56. The operation of network 10 may be described by initially assuming the output of gate 28 at line 46 to be in a high state. This high condition, applied to the input of gate 30, evolves a low output thereof at line 26 which output is recognized at capacitor 42. However, capacitor 42 will be charged from the high value at line 46 through line 52, diode 54 and lower value timing resistor 56. The time constant involved provides the above noted 50 ms sampling period generated in consonance with a low state at line 26. As capacitor 42 thus is charged to a high level, the input to gate 28 correspondingly becomes high, the output of the gate becomes low and the output of gate 30 at line 26 becomes high. Capacitor 42 then discharges through the selectively higher impedance value resistor 50 within line 48. Discharge takes place over a relatively longer interval, for instance about one second, again depending upon the selected time constant of this timing subcircuit. At the termination of such interval, the voltage level at the input of gate 28 passes the transfer-voltage point thereof, and its output at line 46 reverts to a high state. As a result, the output of gate 30 at line 26 reverts to a low state and the oscillatory cycle is reiterated. Stabilizing resistor 44, participating in the alteration of logic levels at line 26, reduces any variations of the oscillatory periods of network 10 as would normally occur with supply voltage variations.

The noted selective oscillation at line 26 between high states of about one second duration and low states of shorter, i.e, 50 ms. duration, as is portrayed in FIG. 2, is utilized for dual purposes within the surveillance function 12 of the system. Note that output line 26 of network 10 is connected through resistor 58 and current limiting resistor 60 to one side of a surveillance light emitting diode (LED) 62. The opposite side of surveillance LED 62 is coupled to power line 22. Line 26 additionally is coupled to line 22 through a regulator network including line 64, a visual status indicator light emitting diode (LED) 66 and supplementary diode 68. This regulator network may be seen to be associated in parallel circuit relationship with surveillance LED 62 and resistor 60.

Surveillance LED 62 is mounted within a dark or light secure chamber suited to receive smoke or aerosols in a manner providing for the illumination by it of select regions thereof. It is energized upon each occurrence of a low state at the output (line 26) of gate 30. With the occurrence of this short, i.e., 50 ms., interval, line 26 is effectively coupled to ground line 24 through gate 30 and line 38. Surveillance LED 62 preferably is selected having high efficiency and low current demand characteristics. For instance a gallium phosphide device may be utilized for the instant purpose.

The illuminational output of surveillance LED 62 is held substantially consistent over the operational lifespan of batteries 18 by operation of the regulator network within line 64. Looking to that network it may be observed that the voltage drop across diodes 66 and 68 remains fixed by virtue of the inherent characteristic of a diode. Since the regulator network is coupled in parallel circuit relationship with surveillance LED 62 and current limiting resistor 60, any drop-off of current (that is, a lowering of battery voltage) available for powering both the regulator network of line 64 and the surveillance LED 62-resistor 60 combination will be accommodated for within the line 64 regulator network, i.e., the amount of current passing through surveillance LED 62 remains substantially constant for any opertional voltage supply condition. A particularly advantageous feature of the regulator network resides in the utilization of one diode thereof, diode 66, as a visual operational status indicator. Diode 66 is a light emitting diode (LED) selected having an illumination output intensity adequately perceptible to the user during the interval of its activation and, accordingly, is mounted externally upon the housing incorporating the instant surveillance and alarm system. To assure adequate perception of the output of LED 66 the earlier described shorter frequency interval of network 10 is selected as the minimum required to achieve human visual perception of an energized LED 66, i.e., about 50 ms. Without such consideration, that interval practically could be reduced, for instance, to about 10 milliseconds or less. As is considered in detail hereinafter, the interval also is selected with a view to the response of the circuit to a detected aerosol.

As noted earlier herein, the instant system utilizes a Tyndall effect type sensing technique wherein suspended particulate matter or smoke, as represented at 70, is illuminated from an energized surveillance LED 62 during a periodic sampling interval. Particle reflection from this illumination is witnessed by a silicon-type Darlington coupled phototransistors 72. Located within the light secure portion of the housing incorporating the system, connected with power line 22 by line 74, detector 72 is selected having as high a gain as possible in view of the relatively lower level light output generated by surveillance LED 62. The Darlington coupled arrangement serves this end as well as the selection of a silicon type device, the latter aspect providing response times considerably faster than conventional devices, i.e., of the cadmium sulfide variety.

In the absence of an aerosol such as smoke within the surveillance environment of the system, detector 72 will witness black, or the absence of light and will remain non-conductive, thereby permitting functions 14 and 16 to maintain a quiescent state.

Assuming that an aerosol of sufficient quantity and/or density is present within the environment of surveillance of the system, detector 72 will rapidly respond by conducting during the short interval of illumination of surveillance LED 62. The degree of such conduction is dependent upon the noted quantity of aerosol present. However, it is important to observe that the level of this smoke detect signal, represented by the noted conduction, generally will be of a value less than the value of dark current spuriously generated within detector 72 during its normal, standby or surveillance mode condition. Such dark currents are developed concomitantly with environmental temperature variations and the like.

In accordance with the present invention, the dark current phenomena of detectors is treated as being d.c. or steady state in nature, while the smoke detecting signals are treated as a.c. variations (only occuring within the surveillance interval) within detector 72. In effect, through the utilization of an intermittent sampling frequency, i.e., once per second in combination with a short sampling interval, i.e., 50 m.s., (see FIG. 2) the noted a.c. variations are, in effect, digitalized to render the circuit immune from temperature effects. As a consequence, silicon detectors, exhibiting very low power demands, may be utilized within the systems, thereby permitting the utilization of practical and convenient battery power supplies.

Looking now with particularity to detect signal response function 14 and a stabilization network 75 with bias clamping means therewithin, and assuming that surveillance LED 62 is off during a high value at output line 26 of network 10, the only current which may be considered as flowing through detector 72 is dark current. Such dark current will flow along line 76 and, simultaneously, through line 78 to the respective bases of NPN transistors 80 and 82. These transistors are matched and transistor 82 is connected within the circuits to utilize its base-emitter characteristic, for example it may be represented as a solid state junction device, such as a diode, its emitter being coupled through line 84 and resistor 86 to power line 24. The collector of transistor 80 is coupled through line 88 and resistor 90 to power line 22, while its emitter is coupled through lines 92 and 94, respectively incorporating resistor 96 and capacitor 98. For reference purposes, the juncture of lines 92 and 94 is identified at 100.

As dark current flows to transistors 80 and 82, a slight voltage drop is witnessed across both resistors 86 and 96. Inasmuch as transistor 80 is fully coupled within the circuit as a transistor, the base current thereof creates a collector current emanating from power line 22 and passing through line 88 and resistor 90. This collector current will tend to drive the voltage value, as at point 100, more positively so as to evolve a condition wherein it becomes impossible for transistor 80 to assume an actively conductive forwardly biased state, i.e., to be turned on "hard". Transistor 82 functions to support the necessary slightly forwardly biased condition of transistor 80 by accommodating any high excursions of dark currents which might otherwise saturate the latter, rendering it immune to or insensitive to the above-noted a.c. type signals of detector 72 representing a smoke detecting condition. While transistor 82 may be replaced by a diode, such diode must be selected having forward drop characteristics essentially simulating the base-emitter characteristics of transistor 80. An equilibrium status is achieved within network 75 as transistor 80 is slightly forwardly biased. Transistor 82 functions to maintain this equilibrium inasmuch as when dark current increases the voltage at point 100 and at the emitter of transistor 82 increases slightly and in unison.

Since collector current is flowing in transistor 80 and its value is the gain of the transistor times the base current, the predominant source of current flow through resistor 96 is collector current. Therefore, in order for the voltage at point 100 and the voltage at the emitter of transistor 82 to remain equal (assuming base emitter drops of both transistors are equal) the greater majority of any increase in the dark current of phototransistor 72 must flow into transistor 82. Dark current levels due to environmental temperature excursion may vary by a factor as high as one hundred, however, such temperature excursions normally will occur over greatly extended periods of time, i.e., their transistion times are very slow. Accordingly, the foregoing d.c. treatment of the dark current phenomena will remain effective for essentially all conditions encountered in typical system usage.

Now considering a condition wherein an aerosol such as smoke is detectible within the system, as surveillance LED 62 is illuminated within the short time envelope of the surveillance interval (i.e., 50 ms.), detector 72 will exhibit a rapid rise or excursion in conductivity. This excursion, by virtue of the noted limited time envelope and the fast rate of rise of light output from LED 62, serves to impose a corresponding current rise excursion at the base of transistor 80. A consequent pulse-type forward biasing of the base-emitter junction of transistor 80 ensues and a collector current flow, again corresponding to the noted pulse application and is impressed from line 88 simultaneously upon resistor 96 and capacitor 98. Note that this collector current flow is significantly heightened due to the gain aspects of transistor 80. The impedance exhibited by capacitor 98 to the a.c. form of the collector current signal thus imposed is low as compared to that exhibited by resistor 96. Capacitor 98 acts as a bypass to this signal and resistor 96 is ignored by the current pulse. As a consequence, a voltage drop relative to ground of highly significant magnitude with respect to any variations otherwise generated at network 75 is witnessed at line 102 for utilization as a detectable signal.

To summarize the above, as an a.c. form of smoke detect signal is generated within the system, transistor 82 will not effectively respond to or witness a significant voltage drop at its collector relative to the dark current signal because of its method of connection within the circuit. Also, resistor 96 will not witness the a.c. nature of the detect signal, but responds only to the d.c. type component representing any dark current. However, capacitor 98 represents a low impedance to the a.c. form of detect signal witnessed. The gain or amplifier performance of transistor 80 permits a very rapid current drive of significant value, which drive is witnessed at line 102 as a significant voltage drop of limited duration defined by the time frame of the surveillance interval. In effect, the detect signal representing a concentration of aerosol which, in itself, can be of a very slow or varying nature, is "digitalized", a "spike" being generated at line 102.

Now looking to the treatment of this "spike", line 102 is coupled to the input of an inverter gate 104. Connected to line 102 at that input is a line 106 incorporating a variable resistor 108 and coupled to power line 24. Gate 104 is coupled to power line 22 through line 110 and to power line 24 through line 112.

Inverter gate 104 functions, under operating conditions of normal battery power supply voltage levels, to respond to any smoke detect signal with a selected consistent degree of sensitivity. In this regard, such inverter gates may be characterized in exhibiting a trigger level at their inputs which, for a given normal range of power supply voltages, will be a selected percentage of that imposed power supply. The gates exhibit an input triggering value characteristic which is substantially linear over normal operational ranges of voltage values applied as power supply. That power supply to gate 104 is applied from lines 110 and 112. In network 14, the sensitivity or triggering condition for gate 104 is set or established by a divider network connected with line 102 and comprising resistor 90 and variable resistor 108. Resistor 108 may be factory adjusted to provide a "normal", surveillance operational mode voltage level at input line 102 which, for instance, is about two percent of the power supply voltage above the trigger voltage level of gate 104. As a consequence, a continual high is imposed upon the gate during the surveillance mode to render its output at line 114 low. However, should a detect signal "spike" appear at line 102, the output of gate 104 at line 114 will invert to a high for an interval corresponding with the noted short surveillance interval. In effect, the smoke detect signal or "spike" has been treated such that the a.c. sensing aspect or component is treated as a step function representative of a smoke detect condition.

Turning now to audio oscillation network 16, a p.m. type loudspeaker 116 is shown connected between power lines 22 and 24 in series circuit relationship with Darlington connected drive transistors 118 and 120. The latter drive transistors are forwardly biased to energize loudspeaker 116 in the presence of a high value at line 122 of the oscillator network. Line 122 remains low during the quiescent surveillance operational mode of the system and is coupled through resistor 124 to the output of an audio oscillator network incorporating inverter gates 126 and 128. Gate 126 is connected between power lines 22 and 24 respectively by lines 130 and 132, while gate 128 is similarly powered respectively through lines 134 and 136. To maintain the necessary low, quiescent value at line 122, it is necessary, under the inverter logic of gates 126 and 128, that line 138, coupling the input of the latter and the output of the former, maintain a high level, while input line 140 to gate 126 remains low. Gates 126 and 128 are arranged in somewhat similar fashion as are the inverter gates of network 10. In this regard, the output of gate 128 is connected through line 142, capacitor 144, line 146 and resistor 148 to line 138. Line 142 further connects capacitor 144 to the input line 140 of gate 126 through stabilizing resistor 150. Input line 140 of the astable multivibrator arrangement thus provided is coupled through a blocking diode 152 and discharge resistor 154 to the output of gate 104 through line 114. It may be noted that the high state of interconnecting line 138 is conveyed via line 146 to portion 156 of line 142. To assure that this high level does not influence a necessary low state at input line 140 during quiescent surveillance modes of operation, resistor 150 is selected having a relatively high impedance with respect to the value of impedance exhibited by discharge resistor 154. With this arrangement, the low state at line 140 is dominated or maintained through the low state at output line 114 of gate 104.

The output of gate 104 at line 114 additionally is coupled through line 158 and a steering diode 160 to line 162. Line 162, in turn, incorporates a latching capacitor 164 and is connected between power line 24 and line 114 at a point 166 intermediate diode 152 and resistor 154.

Assuming that an aerosol or smoke detect signal is received by gate 104, the output thereof converts to a high state for the noted short interval of the signal. As this occurs, latching capacitor 164 is rapidly charged through line 158, steering diode 160 and line 162. As a consequence, point 166, otherwise low, rapidly is driven toward a high state, and the high state at portion 156 of line 142 commences to predominate in controlling the logic level at input line 140 of gate 126. The astable multivibrator circuit of network 16 commences to provide an oscillatory output at line 122 selected to operate p.m. loudspeaker 116 at a frequency effecting peak human audio response. This frequency, determined by the resistance and capacitance, respectively, of resistor 148 and capacitor 144, preferably is selected between about 1 to 4 $KH_z$.

Inasmuch as the high logic state at the line 114 output of gate 104 is transitory, an accommodation is required for maintaining point 166 at a high logic state to provide continued oscillatory drive to loudspeaker 116. Additionally, the oscillator portion of network 16 requires for performance that input line 140 remain independently variable from high to low logic levels in accordance with the selected audio frequency. To accommodate for this requirement, blocking diode 152 serves to isolate line 140 during oscillation. A latched and continued operation of the audio oscillator circuit is provided by a feedback line 168 incorporating a blocking diode 170 and extending from the output of gate 128 to point 166. With this arrangement, as line 140 assumes a high value, the output of gate 126 becomes low and the output of gate 128 becomes high. This high logic level is impressed through line 168 and diode 170 upon point 166 and through line 162 to latching capacitor 164. In consequence, a necessary high logic level is maintained at point 166 even though the output of gate 104 reverts to a low logic level at the termination of a given detect signal. Inasmuch as the high logic level is impressed from feedback line 168 at the audio frequency of the oscillator circuit of network 16, adequate maintenance of the level is realized. To further assure such performance, the impedance value of discharge resistor 154 is selected so that its discharge relationship with capacitor 164 is such that the capacitor cannot discharge sufficiently to deleteriously lower the subject high logic level by the time additional high levels are received from feedback line 168.

A reset switch 172 is provided within a line 174 extending in discharge or shunting relationship across capacitor 164. When this switch is closed, capacitor 164 is discharged and a low logic level is availed at point 166 to effect the shutting down of the audio oscillation network 16. The surveillance and alarm arrangement of the invention also provides an indication of low battery power supply levels. In this regard, it is a characteristic of inverter gate 104 that as the supply voltage imposed thereupon, as from lines 110 and 112, drops below the earlier described normal or standard operating range of the gate, the trigger level value becomes variable or nonlinear. This variance is to an extent that the triggering voltage for the gate alters to a higher percentage of the now diminishing supply voltage level and ultimately approaches and reaches that level. Since the input voltage level, as defined by the divider network including resistors 90 and 108, remains a fixed percentage of supply voltage, the voltage asserted at input line 102 to gate 104 eventually will drop to cause the gate to react by triggering and creating a continuous high logic level at line 114. Of course, in the event the battery surveillance voltage falls below that necessary for proper failure, the output of LED 66 will diminish in intensity or the device will cease to be illuminated. Exemplary of the inverter gates, including gate 104 which may be utilized within the circuit is model CD4049A marketed by RCA Corporation.

As a final aspect of the performance of gate 104 within the circuit, due to the above-described characteristic wherein the degree of sensitivity to triggering increases as supply voltage falls off, the circuit of the system becomes more sensitive as the battery supply ages, i.e., the input voltage differential to triggering drops off. In more conventional Tyndall effect smoke detecting schemes the opposite holds true.

Since certain changes may be made in the above described apparatus and system without departing from the scope of the invention herein involved, it is intended that all matter contained in the above description or shown in the accompanying drawings shall be interpreted as illustrative and not in a limiting sense.

I claim:

1. Surveillance apparatus for detecting the presence of aerosols within an environment comprising:

light emitting means energizable to provide a region of radiation:

oscillator means for energizing said light emitting means during surveillance intervals of short duration, said surveillance interval energization being effected at a sampling frequency having a period substantially greater than a said surveillance interval;

detector means, characterized by the presence of temperature dependent dark current phenomena and exhibiting a first signal condition in response thereto, said detector means further being characterized in having a high rate of response to the presence of aerosol within said region of radiation and exhibiting a second signal condition in correspondence therewith;

stabilization network means responsive to discriminate said first signal condition, as steady state in nature, from said second signal condition, and including amplifier means coupled with said detector means and comprising a transistor stage and bias clamping means for retaining said transistor stage in a partially forwardly biased condition in the presence of said first signal condition, said amplifier means being responsive to said second signal condition to generate a detect signal output as a step function; and means responsive to said detect signal output for generating an alarm signal.

2. The surveillance apparatus of claim 1 in which said stabilization network means amplifier means bias clamping means for retaining said transistor stage in a partially forwardly biased condition is coupled with said detector means for response to said first signal condition, said transistor stage being responsive to said second signal condition to derive said detect signal output as a said step function signal of duration substantially corresponding with said surveillance interval.

3. The surveillance apparatus of claim 1 in which said detector means is present as at least one photoresponsive solid state silicon device responsive to reflection from said aerosols within said region of radiation, conductive to provide a substantially steady state current as said first signal condition, and conductive during said surveillance interval in response to said reflections to derive said second signal condition as current flow transitory within the time frame of said surveillance interval.

4. The surveillance apparatus of claim 3 in which said stabilization network means transistor stage of said amplifier means is coupled with parallel connected resistor means and capacitor means for effecting an amplification only of said second signal condition transitory current flow to derive said detect signal output as a step function.

5. The surveillance apparatus of claim 4 in which said detector means are Darlington connected silicon phototransistors; and including gate means having an input coupled for response to said detect signal output when the voltage asserted at said input is altered by said detect signal output to reach a predetermined level designated a triggering level.

6. The surveillance apparatus of claim 1 in which:

said detector means comprises at least one photoresponsive solid state silicon device; and said stabilization network means amplifier means transistor stage is coupled to receive current from said photoresponsive solid state silicon device, said bias clamping means comprises solid state junction device means having a base-emitter type characteristic substantially corresponding to that of said transistor stage, said solid state junction device means effecting maintenance of said transistor stage in said partially forwardly biased condition in the presence of said first signal condition and said amplifier means includes capacitor means coupled with said transistor stage and operative in conjunction therewith to effect an amplification only of current deriving from said second signal condition to provide said detect signal output as a said step function.

7. Surveillance apparatus for detecting the presence of smoke within an environment comprising:

emitting means energizable to provide a region of radiation;

oscillator means for energizing said source from a battery power supply during intervals of surveillance, said surveillance interval energization being carried out at a predetermined sampling frequency;

detector means, characterized in having a high rate of response to the presence of smoke within said region of radiation and exhibiting a predetermined signal condition in correspondence therewith;

means responsive to said predetermined signal condition to generate a transient voltage output signal;

gate means operatively coupled with said power supply having an input coupled for response to said output signal, having an input triggering value characteristic substantially linear over a predetermined normal operational range of voltage values applied from said power supply thereto, exhibiting an input triggering voltage value characteristic nonlinearly approaching said applied voltage values when said values are below said normal operational range and for generating an output signal in the presence of a triggering level voltage at its input;

control means for applying a threshold voltage at said input having a value representing a percentage of the value of voltage of said power supply, said threshold voltage value determining the level of said voltage output signal required to effect a said triggering of said gate means to establish the sensitivity thereof, whereby the said sensitivity of said gate means is enhanced when said power supply voltage values are below said normal range; and means responsive to said gate means output signal for generating an alarm signal.

8. The surveillance apparatus of claim 7 wherein:

said control means threshold input voltage value is so selected with respect to said gate means input triggering value characteristic such that said gate means is triggered to generate said output signal when said applied power supply voltage values fall below a predetermined level; and said means responsive to said gate means output signal includes audio frequency alarm means to provide an audibly perceptive alarm.

9. The surveillance apparatus of claim 7 in which:

said emitting means comprises a light emitting diode coupled for selective energization from said battery power supply, and including diode means coupled in parallel circuit relationship with said light emitting diode and exhibiting a substantially fixed voltage drop when energized from said power supply.

10. The surveillance apparatus of claim 7 in which:

said emitting means comprises a light emitting diode coupled for energization from said battery power supply during said intervals of surveillance;

and including:

diode means including at least a second light emitting diode visible externally of said apparatus when energized, said second light emitting diode coupled in parallel circuit relationship with said light emitting diode and exhibiting a substantially fixed voltage drop when energized; and said alarm signal is generated as an audibly perceptive alarm.

11. The surveillance apparatus of claim 7 in which:

said emitting means comprises light emitting means energizable to provide a region of illumination;

said oscillator means intervals of surveillance are of selected short duration and said sampling frequency is selected having a period substantially greater than a said surveillance interval;

said detector means is characterized by the presence of temperature dependent dark current phenomena and exhibits a first signal condition in response thereto, said detector means further being characterized in having a high rate of response to the presence of smoke within said path of illumination and exhibits said predetermined signal condition as a second signal condition in correspondence therewith, and said means responsive to said predetermined signal condition includes stabilization network means responsive to discriminate said first signal condition, as steady state in nature, from said second signal condition for generating said transient voltage output signal in response to said second signal condition.

12. The surveillance apparatus of claim 11 in which said stabilization network means comprises a transistor stage and means for maintaining said transistor stage in a partially forwardly biased state, said transistor stage being responsive to said second signal condition to derive said transient voltage output signal as a step function signal of duration substantially corresponding with said surveillance interval.

13. The surveillance apparatus of claim 11 in which said detector means is present as at least one silicon phototransistor responsive to the presence of smoke within said region, conductive to provide a substantially steady state current as said first signal condition, and conductive during said surveillance interval in response to said presence of smoke within said region to derive said second signal condition as trasitory current flow within the time frame of said surveillance interval.

14. The surveillance apparatus of claim 13 in which said stabilization network means comprises amplifier means coupled with said detector means and configured and arranged to amplify only said second signal condition transitory current flow to generate said transient voltage output signal.

15. The surveillance apparatus of claim 14 in which said detector means are Darlington connected silicon phototransistors.

16. The surveillance apparatus of claim 11 in which:

said detector means comprises at least one silicon phototransitor; and said stabilization network means comprises amplifier means including a transistor stage coupled to receive current from said phototransistor, and diode means having a baseemitter characteristic substantially corresponding to that of said transistor stage, said amplifier means and said diode means being configured and arranged to maintain said transistor stage in a partially forwardly biased condition in the presence of said first signal condition and to amplify current deriving from said phototransistor as said second signal condition to provide said transient voltage output signal.

17. The surveillance apparatus of claim 1 in which:

said light emitting means, said oscillator means, said detector means and said stabilization network means are mounted within a housing;

said light emitting means comprises a light emitting diode coupled for energization from a source of power; and including diode means coupled in parallel circuit relationship with said light emitting diode and exhibiting a substantially fixed voltage drop when energized from said source.

18. The surveillance apparatus of claim 17 in which said diode means includes a light emitting diode mounted upon said housing for visibility externally of said apparatus when energized.

* * * * *

UNITED STATES PATENT OFFICE
CERTIFICATE OF CORRECTION

Patent No. 4,063,227 Dated December 13, 1977

Inventor(s) Christian C. Petersen

It is certified that error appears in the above-identified patent and that said Letters Patent are hereby corrected as shown below:

The inventor's name is misspelled, it should read:

Christian C. Petersen

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*